US011324654B2

(12) United States Patent
Kim et al.

(10) Patent No.: US 11,324,654 B2
(45) Date of Patent: May 10, 2022

(54) REHABILITATION DEVICE

(71) Applicant: LEADERS REHAB ROBOT, Daegu (KR)

(72) Inventors: Yeung Ki Kim, Daegu (KR); Ki Beom Kim, Daegu (KR)

(73) Assignee: LEADERS REHAB ROBOT, Daegu (KR)

( * ) Notice: Subject to any disclaimer, the term of this patent is extended or adjusted under 35 U.S.C. 154(b) by 314 days.

(21) Appl. No.: 16/561,435

(22) Filed: Sep. 5, 2019

(65) Prior Publication Data

US 2021/0069051 A1 Mar. 11, 2021

(51) Int. Cl.

| | |
|---|---|
| ***A61H 1/02*** | (2006.01) |
| ***A63B 23/16*** | (2006.01) |
| *A63B 21/055* | (2006.01) |

(52) U.S. Cl.

CPC ..... *A61H 1/0285* (2013.01); *A63B 23/16* (2013.01); *A61H 1/0218* (2013.01); *A61H 2201/1635* (2013.01); *A61H 2205/065* (2013.01); *A63B 21/055* (2013.01)

(58) Field of Classification Search

CPC ..... A61H 1/0285; A61H 1/0218; A61H 2201/1635; A61H 2205/065; A61H 1/0277; A61H 1/0288; A61H 2201/123; A61H 2201/1676; A61H 1/02; A61H 1/0274; A61H 2201/1246; A61H 2205/067; A63B 23/16; A63B 21/055; A63B 23/14; A63B 21/4021

See application file for complete search history.

(56) References Cited

U.S. PATENT DOCUMENTS

| | | | | |
|---|---|---|---|---|
| 2007/0038161 | A1* | 2/2007 | Bonutti | A61H 1/008 601/5 |
| 2010/0305717 | A1* | 12/2010 | Tong | A63B 21/4021 623/64 |
| 2011/0282253 | A1* | 11/2011 | Menon | A61F 5/013 601/40 |
| 2013/0072829 | A1* | 3/2013 | Fausti | A63B 21/00178 601/40 |

FOREIGN PATENT DOCUMENTS

| | | | |
|---|---|---|---|
| KR | 10-2003-0008189 | A | 1/2003 |
| KR | 10-2019-0003280 | A | 1/2019 |
| KR | 10-2019-0008586 | A | 1/2019 |

* cited by examiner

*Primary Examiner* — Quang D Thanh

(74) *Attorney, Agent, or Firm* — Paratus Law Group, PLLC

(57) ABSTRACT

A rehabilitation device includes a first support unit adapted to support palms of a rehabilitation patient; a second support unit which is provided in one side of the first support unit and adapted to support fingers of the rehabilitation patient; a driving unit which moves the second support unit toward a direction of a back of a hand of the rehabilitation patient; and a joint unit which allows the first support unit to be tilted as the second support unit moves.

10 Claims, 5 Drawing Sheets

REHABILITATION DEVICE

BACKGROUND

The technique disclosed in the present specification relates to a rehabilitation device for a human body, and more particularly, to a rehabilitation device which is capable of an extension exercise that corresponds to the joints of hands of a rehabilitation patient.

A previously filed Korea Patent Application Publication No. 10-2003-0008189 (published on Jan. 24, 2003, "auto finger exercise") discloses a technique, in which when a finger is inserted to press the motor 8 operation button mounted on a wrist, the motor 8 rotates and guy-wires 9 and 10 connected to the motor pull the guy-wires 9 and 10 by rotation of the teeth 7 of the motor 8 and the guy-wires attached to the end of the finger 2 slowly move to a palm 6 and detect the pressure of the sensor installed in the palm and the operation of the motor 8 stops and the guy-wires return to their original state by elasticity of the band attached to the back of the hands.

A previously filed Korea Patent Application Publication No. 10-2019-0003280 (published on Jan. 9, 2019, "upper limb rehabilitation robot") discloses a technique, which includes a finger exercise unit mounted on the back of a hand of a patient to rehabilitate the patient's finger; a wrist exercise unit provided on the wrist area of the patient to exercise the wrist of the patient; and an upper limb exercise unit disposed to be spaced apart from the wrist exercise unit so as to exercise the upper limbs of the patient. Furthermore, the finger exercise unit includes a unit which is to be worn on the back of the hand of a patient; a strap which forms a movement path on the unit which is to be worn on the back of the hand; a finger coupling unit which supports one end of the strap and is coupled to a finger of the patient; and a strap driving unit which is provided in the unit that is to be worn on the back of the hand and winds and unwinds the strap supported by the finger coupling unit; wherein the strap driving unit includes a strap winding roller by which the strap is wound and unwound; a strap driving unit that rotates the strap winding roller forwardly and reversely; and a strap guide roller which is provided on the movement path of the strap and guides the movement of the strap; wherein the wrist exercise unit includes a wrist cradle on which the wrist is rested; and a track which is provided along the rotation track of the wrist and guides the rotary movement of the wrist cradle.

A previously filed Korea Patent Application Publication No. 10-2019-0008586 (published on Jan. 25, 2019, "training apparatus for actively rehabilitating fingers and wrist") discloses a training apparatus for actively rehabilitating fingers and wrist, which includes an arm fixing module that includes a pedestal and an arm fixing unit fixed to the pedestal; a wrist rotation module that includes a support through which the arm of a patient is passed and which is fixed to the pedestal and a rotating body coupled to the support and rotated; a coupling unit extending outward from the top of the rotating body; a left and right wrists refractive module that is rotatably coupled to the coupling unit so as to rotate the patient's wrist from side to side; a wrist up and down refractive module that is hinge-coupled to the left and right wrists refractive module to bend the patient's wrists up and down; and a finger rehabilitation module that includes a plurality of finger rehabilitation units which are coupled to the wrist up and down refractive module and fold each finger of the patient.

The conventional rehabilitation devices described above have been developed for the extension exercise to clench and followed by extending the fist, and it is not possible to perform a maximum extension exercise in which the tips of fingers are bent toward the back of the hand.

SUMMARY OF THE INVENTION

As such, the technology disclosed in the present specification intends to provide a rehabilitation device which enables an extension exercise where the tips of fingers can be maximally bent toward the direction of the back of a hand.

Furthermore, the technology disclosed in the present specification intends to provide a rehabilitation device which enables the sequential proceeding of the extension exercise of the wrist by an extension exercise of fingers.

In an embodiment, a rehabilitation device is disclosed.

The rehabilitation device includes a first support unit 100 which supports palms; a second support unit 200 which is provided in one side of the first support unit 100 thereby supporting fingers; a driving unit 300 which moves the second support unit 200 toward the direction of the back of a hand; and a joint unit 400 which allows the first support unit 100 to be tilted as the second support unit 200 moves.

The joint unit 400 includes a first joint unit 410 which allows the first support unit 100 to rotate freely; a second joint unit 420, which, while connecting the first support unit 100 and the second support unit 200, allows the second support unit 200 to rotate freely; and a restriction unit 430, which, while being provided in the first support unit 100, restricts the rotation of the second support unit 200 thereby rotating the first support unit 100 as the second support unit 200 moves.

The driving unit 300 includes a moving unit 310 which, while being positioned from the first support unit 100 toward the second support unit 200, moves forward and backward under the first support unit 100 or the second support unit 200; a driving connection unit 320 which connects the moving unit 310 and the second support unit 200; and a rotation structure 330 which allows the driving connection unit 320 to rotate freely by the forward movement of the moving unit 310 thereby moving the second support unit 200 upward.

The rehabilitation device further includes a secondary rehabilitation unit 500, which, being provided in the first support unit 100, allows the thumb of the fingers to be folded and then extended, wherein the secondary rehabilitation unit includes a third support unit 510, which, being provided in the first support unit 100, is provided in one side of the second support unit 200, thus being able to rotate toward the direction of a side of the second support unit 200; a rotation guide 520, which, while being protruded in a lower part of the third support unit 510, is tilted toward the direction of movement of the moving unit 310 from the outside of the third support unit 510 to the inside of the third support unit 510; and a secondary moving unit 530, which, while being provided to move along with the moving unit 310, comes into contact with the rotation guide 520 and pushes while being sled thereby rotating the third support unit 510.

The secondary rehabilitation unit 500 may be provided on both sides of the second support unit 200.

The secondary rehabilitation unit 500 may further include a secondary return unit 540 which, while being connected to the third support unit 510 and the first support unit 100, returns the rotated third support unit 510.

The rehabilitation device may further include a ball caster 600, which, being provided in a lower part of the driving unit 300, allows to move freely by an external force.

The rehabilitation device may further include a wrist fixing unit 700, which, being provided in the driving unit 300, fixes a wrist; and may further include an arm resting unit 800, which, being provided in the driving unit and comes into contact with a particular part from a wrist to an elbow, is tilted toward the thumb direction as the arm resting unit 800 goes upward.

The rehabilitation device disclosed in the present specification enables the performance of an extension exercise in the sequential order of fingers and a palm (wrist) toward the direction of the back of a hand; and an extension exercise in the sequential order of a palm (wrist) and fingers toward the direction of the palm.

The rehabilitation device disclosed in the present specification can force an extension exercise, in which a thumb present in one hand of a rehabilitation patient supported through a first support unit 100 or a second support unit 200 via a secondary rehabilitation unit 500 is extended and then bent, and has the rehabilitation device having two secondary rehabilitation units 500 has the effect of optionally using either the left hand or right hand.

The rehabilitation device disclosed in the present specification can selectively change the position of an arm through a ball caster 600 while the hand is rested on the rehabilitation device and thereby can change the stimulus according to the extension exercise, and proceed with the extension exercise from the fingers to the shoulder.

The rehabilitation device disclosed in the present specification has the effect of being capable of easily releasing excessive pain caused by extension exercise through a wrist fixing unit 700 and an arm receiving unit 800.

The details described above only provide only selective concepts in a simplified form for the details to be followed. The present disclosure provided is not intended to limit the main or essential features of the claims or to limit the scope of the claims.

DETAILED DESCRIPTION

Figure 1:
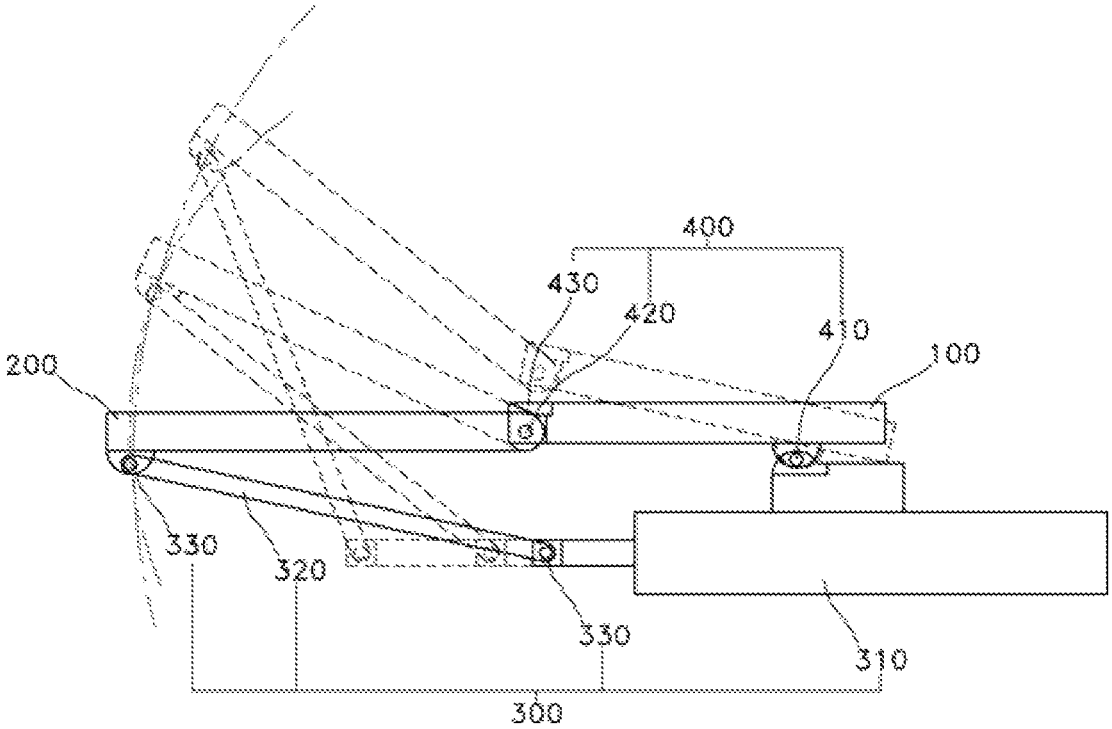
FIG. 1 illustrates a side view according to an embodiment disclosed in the present specification.

Hereinafter, exemplary embodiments disclosed in the present specification will be described in detail with reference to the accompanying drawings. Unless indicated otherwise in the specification, like reference numerals in the drawings shall indicate like elements. The exemplary embodiments described in the detailed description, drawings, and claims are not intended to limit the scope of description, drawings, and claims, but other embodiments may also be used. Other modifications may be also possible as long as they do not depart from the spirit or scope of the technology disclosed herein. Those skilled in the art can arrange, configure, combine, and design the components of the present disclosure (i.e., the components generally described herein and described in the figures) in various other configurations, and will easily understand that all of these are obviously devised and form parts of the present disclosure. In order to explicitly express various layers (or membranes), regions, and shapes in the drawings, the width, length, thickness, or shape of the components may be exaggerated.

When one component is referred to as "provided in" another component, it may include a case where an additional component is interposed therebetween, in addition to the case where the one component is directly provided to the other component.

When one component is referred to as "connected to" another component, it may include a case where an additional component is interposed therebetween, in addition to the case where the one component is directly connected to the other component.

When one component is referred to as "coupled to" another component, it may include a case where an additional component is interposed therebetween, in addition to the case where the one component is directly coupled to the other component.

Since the descriptions on the techniques disclosed are merely embodiments for structural or functional description, the proprietory rights with respect to the disclosed techniques should not be construed as being limited by the embodiments described herein. That is, since the exemplary embodiments may be modified variously and may have various forms, the proprietory rights with respect to the disclosed techniques should be understood to include equivalents capable of realizing the technical ideas.

Singular expressions should be understood to include plural expressions unless the context clearly indicates otherwise, and terms such as "include" or "have" are intended to indicate that there are features, numbers, steps, actions, components, parts, or combinations thereof implemented, and it should be understood that it does not exclude in advance the possibility of the presence or addition of one or more other features or numbers, steps, actions, components, parts or combinations thereof.

All terms used herein have the same meaning as commonly understood by those of ordinary skill in the art to which the disclosed technology belongs, unless otherwise defined. As defined in the commonly used dictionaries, the terms should be construed to be consistent with the meanings in the context of the related art and should not be construed as having ideal or overly formal meanings unless expressly defined in this application.

Figure 2:
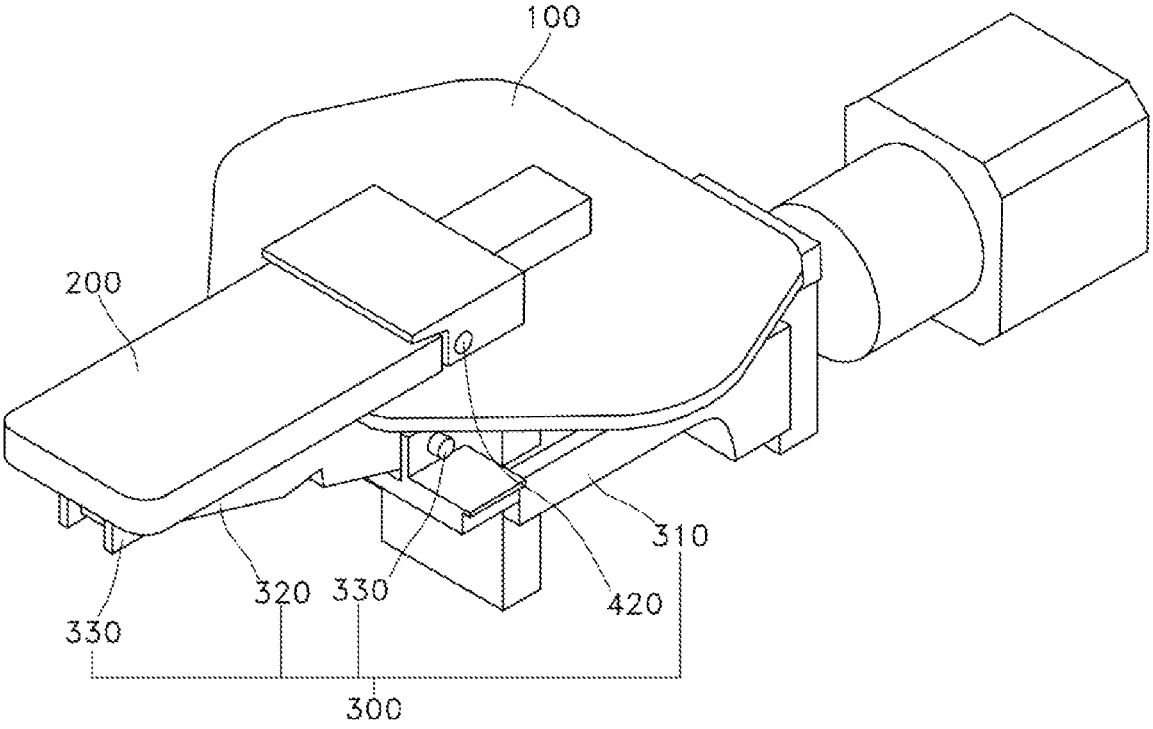
FIG. 2 illustrates a side view of a moving unit according to another embodiment disclosed in the present specification.
Figure 3:
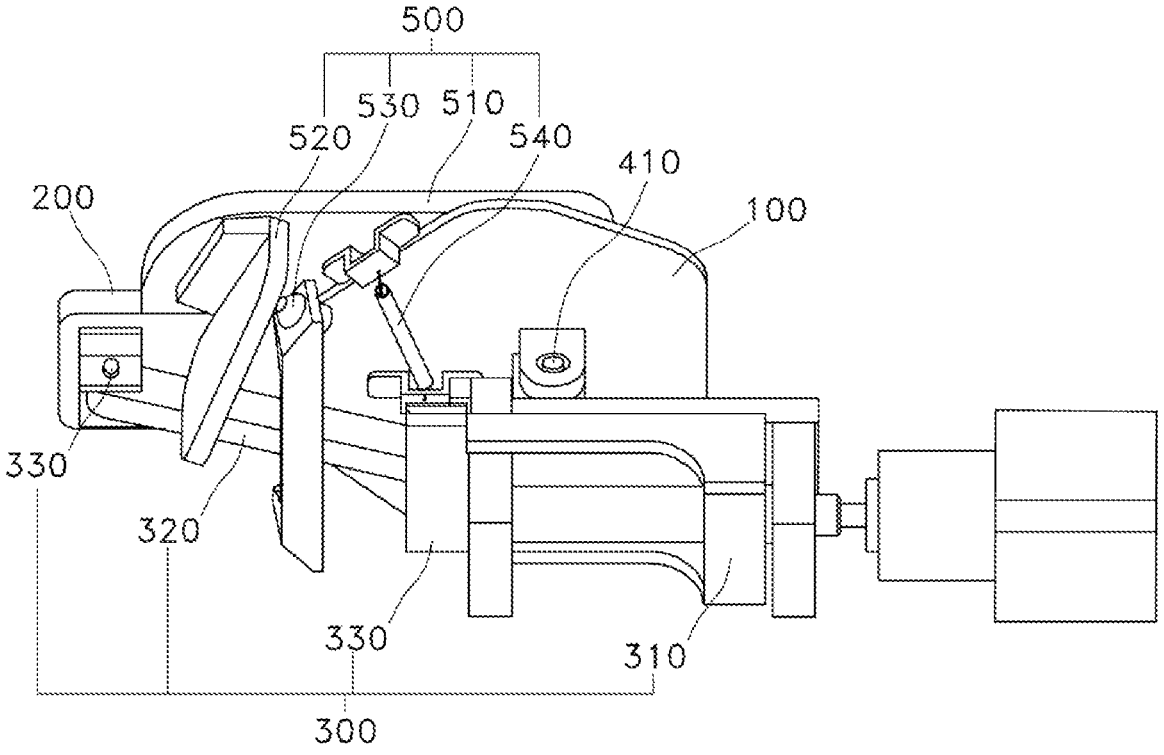
FIG. 3 illustrates a view of a secondary rehabilitation unit disclosed in the present specification.
Figure 4:
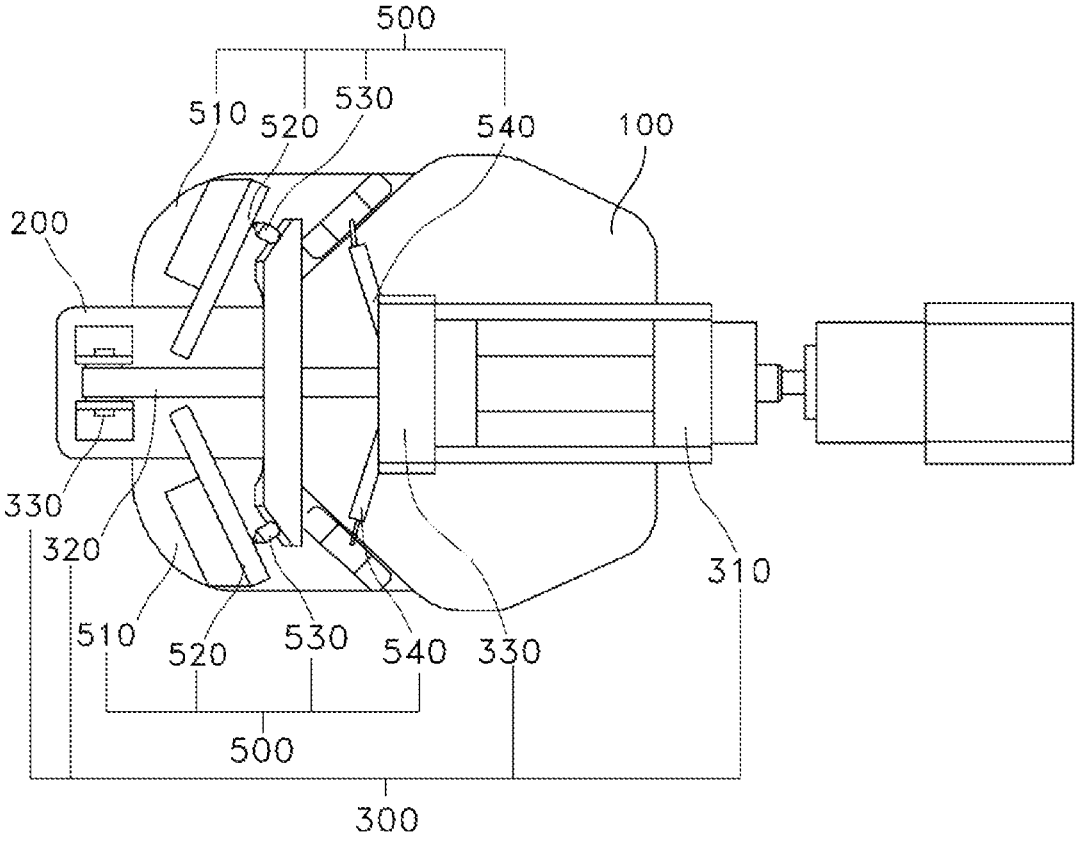
FIG. 4 illustrates a view of a secondary rehabilitation unit according to another embodiment disclosed in the present specification.
Figure 5:
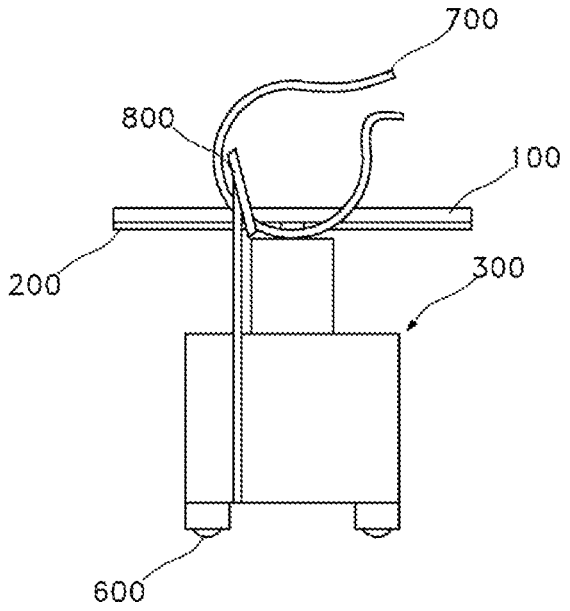
FIG. 5 illustrates another embodiment disclosed in the present specification.
Figure 6:
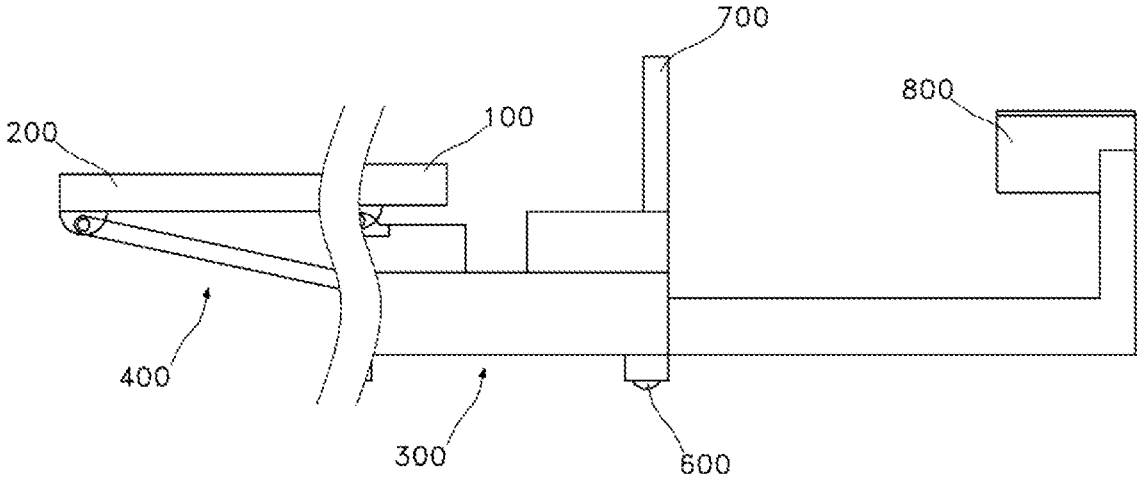
FIG. 6 illustrates a side view according to another embodiment disclosed in FIG. 5.

FIG. 1 of the accompanying drawings in the present specification. 1 is a view illustrating a side view according to an embodiment disclosed in the present specification. FIG. 2 illustrates a side view of a moving unit according to another embodiment disclosed in the present specification. FIG. 3 illustrates a view of a secondary rehabilitation unit disclosed in the present specification. FIG. 4 illustrates a view of a secondary rehabilitation unit according to another embodiment disclosed in the present specification. FIG. 5 illustrates another embodiment disclosed in the present specification. FIG. 6 illustrates a side view according to another embodiment disclosed in FIG. 5.

Hereinafter, the rehabilitation device disclosed in the present specification will be outlined below with reference to the accompanying drawings. The rehabilitation device referring to the drawing include a first support unit 100 which supports palms; a second support unit 200 which is provided in one side of the first support unit 100 thereby supporting fingers; a driving unit 300 which moves the second support unit 200 toward the direction of the back of a hand; and a joint unit 400 which allows the first support unit 100 to be tilted as the second support unit 200 moves.

In some other embodiments, the rehabilitation device may optionally further include a secondary rehabilitation unit 500.

In some other embodiments, the rehabilitation device may optionally further include a ball caster 600.

In some other embodiments, the rehabilitation device may optionally further include a wrist fixing unit 700 and an arm receiving unit 800.

Hereinafter, the present invention will be described in detail with reference to the drawings.

The rehabilitation device with reference to FIG. 1 or FIG. 2 approximately includes a first support unit 100, a second support unit 200, a driving unit 300 and a joint unit 400.

The first support unit 100 with reference to FIG. 1 or FIG. 2 supports the palm of a rehabilitation patient. The first support unit 100 may be provided to have an area, a size, and a shape that can support the palm of a rehabilitation patient. The palm of a hand means the part between a wrist and fingers.

Meanwhile, the first support unit 100 may be installed in a separate cover which covers the rehabilitation device disclosed in the present specification or may be installed in the driving unit 300 as shown in FIG. 1.

The second support unit 200 may be provided on one side of the first support unit 100 to support fingers. The second support unit 200 may be provided in the form of a plate. To explain more specifically with reference to FIG. 1 or FIG. 2, the second support unit 200 is provided to support the second to fifth fingers of one hand of a rehabilitation patient.

Meanwhile, the second support unit 200 may be provided so as to individually support each of the second to fifth fingers of a rehabilitation patient.

The driving unit 300 may be provided so as to move the second support unit 200 to the direction of the back of a hand.

According to some exemplary embodiments, the driving unit 300 may optionally further include a connection unit 320 and a rotation structure 330.

The driving unit 300 according to an embodiment (not shown) may include a moving unit 310 provided so as to reciprocate forward and backward. The moving unit 310 may be provided as a conventional cylinder, etc. for reciprocating the lead screw or the piston rotated by a conventional motor. The moving unit 310 may be provided at an end of the second support unit 200. The driving unit 300 may be provided to allow the second support unit 200 to move to an upward direction, i.e., a direction toward the back of a hand of a rehabilitation patient. The driving unit 300 moves the second support unit 200 to an upward direction and thereby make the fingers of the rehabilitation patient to be flipped toward the palm direction. That is, a finger extension exercise is forced, in which when the moving unit 310 moves forward, fingers are flipped, whereas when the moving unit 310 moves backward, the fingers are returned.

Meanwhile, the driving unit 300 may be installed on a separate cover that covers the rehabilitation device shown in the present specification, or may be fixed to the floor, etc.

The driving unit 300 according to an embodiment referring to FIG. 1 may roughly include a moving unit 310, a driving connection unit 320, and a rotation structure 330.

The driving unit 310 referring to FIG. 1 may be provided with a conventional cylinder described above. The driving unit 310, being disposed in a direction from the first support unit 100 toward the second support unit 200, moves back and forth in a lower part of the first support unit 100 or second support unit 200.

The driving unit 320 referring to FIG. 1 connects the moving unit 310 and the second support unit 200. The driving connection unit 320 may be provided in the form of a rod. One side of the driving connection unit 320 may be provided at an end of the second support unit 200. The other end of the driving connection unit 320 is provided in the moving unit 310. That is, the driving connection unit 320 is installed in a tilted direction upward as the driving connection unit 320 goes toward the direction of the second support unit 200. The driving connection unit 320 delivers the force to move the moving unit 310 forward and backward to the second support unit 200.

The rotation structure 330 referring to FIG. 1 may be provided with a conventional hinge structure. The rotation structure 330 pushes the second support unit 200 upward by allowing the driving connection unit 320 to rotate freely from the advance movement of the moving unit 310. More specifically, the rotation structure 330 is provided at one side of the second support unit 200 and the driving connection unit 320 so that one side of the second support unit 200 and the driving connection unit 320 can rotate freely with each other. The rotation structure 330 transforms the direction of a force that is created by the moving unit 310 through a driving connection unit 320. More specifically, when the moving unit 310 advances in a lateral direction toward which the second support unit 200 faces, the force of the moving unit 310 is converted to the tilted longitudinal direction by the driving connection unit 320 and delivered to the second support unit 200. In particular, the rotation structure 330 causes the driving connection unit 320 to be transformed in response to a change in position or movement of the second support unit 220 by the transmitted force. The rotation structure 330 can continuously deliver the power of the moving unit 310 to the second support unit 220, whose position is altered or shifted by the driving connection unit 320 transformed by the rotation structure 330.

Meanwhile, the moving unit 310 may be provided by the lead screw rotated by a conventional motor as in FIG. 2 or FIG. 4. The moving unit 310 may be provided on both sides of the screw connected to the motor. The bearings are fixed to the ground or to a cover or ground, etc. covering the rehabilitation device revealed in the present specification. The surface of the bearings may include a plane. A guide having a face opposite to the plane of the bearings may also be included. The guide is coupled to the surface of the nut fastened to the screw. The rotation of the nut is suppressed as the guide comes into contact with the bearing plane. The nut may move forward or backward depending on the direction of rotation of the screw. The guide moves forward or backward as the nut moves. At an end of the guide, one side of the driving connection unit 320 is connected through the rotation structure 330. The first support unit 100 may be coupled to the upper surface of the bearings.

A joint unit 400 causes the first support unit 100 to tilt as the second support unit 200 moves. The joint unit 400 roughly includes a first joint unit 410, a second joint unit 420, and a restriction unit 430.

The first joint unit 410 referring to FIG. 1 allows the first support unit 100 to rotate freely. More specifically, the first joint unit 410 is provided to have a conventional hinge structure. The first joint unit 410 may be provided at the point where the first support unit 100 and the driving unit 300 are conjugated. The first joint unit 410 may be provided to rotate freely in the moving direction of the second support unit 200 described above. The first joint unit 410 can move the palm of a rehabilitation patient rested on the first support unit 100 when the first joint unit 410 is rotated by an external force using the fixed driving unit 300 as a support. That is, an extension exercise, where the wrist is flipped toward the direction of the back of a hand or toward the direction of the palm, is forced on the hand of a rehabilitation patient according to the first support unit 100 that is rotated using the first joint unit 410 as a rotation axis.

The second joint unit 420 referring to FIG. 1, which connects the first support unit 100 and the second support unit 200, allows the second support unit 200 to rotate freely. More specifically, the second joint unit 420 is provided to have a conventional hinge structure. The second joint unit 420 connects the first support unit 100 and the second support unit 200 with a hinge structure. The second joint unit 420 is provided on a side opposite to one side of the second support unit 200, in which the driving connection unit 320 described above is provided. The second joint unit 420, which is provided in the second support unit 200, is provided on a side of the first support unit 100 and thereby connects the first support unit 100 and the second support unit 200 with a hinge structure. The second joint unit 420 causes the second support unit 200 to rotate about the second joint unit 420 when a force is applied to the second support unit 200 by the driving unit 300 described above. That is, the second joint unit 420 assists the extension exercise, in which the fingers of a rehabilitation patient rested the second support unit 200 are flipped to the direction of the back of the hand and the direction of the palm, to be suitable for the joint structure between finger bones and metacarpal bones.

The restriction unit 430 referring to FIG. 1, which is provided in the first support unit 100, restricts the rotation of the second support unit 200, and thus, the first support unit 100 rotates as the second support unit 200 moves. More specifically, the restriction unit 43 may be provided in the first support unit 100 on the side in which the second joint unit 420 described above is provided. One side of the restriction unit 430 may be provided with a size or shape to be able to come into contact with the upper surface of the second support unit 200. The restriction unit 430 may be provided to be spaced apart from the upper surface of the second support unit 200 by a predetermined distance. The distance spaced apart from the second support unit 200 determines the range within which the second support unit 200 can rotate relative to the first support unit 100. The restriction unit 430 causes the upper surface of the second support unit 200 to be engaged when the second support unit 200 rotates by the driving unit 300 described above. When the force by the driving unit 300 described above is continued to be applied in a state where the rotation of the second support unit 200 is restricted by the restriction unit 430, the second support unit 200 rotates about the first joint unit 410 and moves in the direction of the back of the hand. In particular, the first support unit 100 also rotates around the first joint unit 410. That is, the restriction unit 430 restricts the rotation of the second support unit 200 and thereby causes the first support unit 100 to rotate as the second support unit 200 moves.

In the rehabilitation device according to an embodiment described above, as a primary step, a first-step extension exercise where fingers are flipped to the direction of back of the hands or palms can be performed through the second support unit 200 which rotates by the driving unit 300 may be performed.

In the rehabilitation device according to an embodiment described above, a second-step extension exercise where palms are flipped to the direction of back of the hands or palms in a state where the fingers are flipped through the first support unit 100 which rotates by movement of the second support unit 200.

In the rehabilitation device according to an embodiment described above, an extension exercise may be performed in the sequential order of fingers and a palm (wrist) toward the direction of the back of a hand; and an extension exercise may be performed in the sequential order of a palm (wrist) and fingers toward the direction of the palm.

The rehabilitation device referring to FIG. 3 or FIG. 4 illustrated in other embodiments may further include a secondary rehabilitation unit 500. The secondary rehabilitation unit 500 is provided in a first support unit 100 to pinch and extend thumb a finger out of a finger and allows the thumb among the fingers to clench and then extended. More specifically, the secondary rehabilitation unit 500 may roughly include a third support unit 510, a rotation guide 520, and a secondary moving unit 530.

According to other embodiments, a secondary return part 540 may be further included.

The third support unit 510, which is provided in the first support unit 100, is provided in one side of the second support unit 200 and rotates freely to the direction of the side of the second support unit 200. To explain more specifically referring to FIG. 3 or FIG. 4, the third support unit 510 supports the thumb of a hand supported by the first support unit 100 or the second support unit 200. The third support unit 510 may be provided in the position, size, or shape being capable of supporting the thumb. The direction of the rotation of the third support unit 510 is a lateral direction of the second support unit 200. For the rotation of the third support unit 510, one side of the third support unit 510 and the other side of the first support unit 100, in which the second support unit 200 is not disposed, are connected through a hinge structure.

The rotation guide 520 which, while being protruded in a lower part of the third support unit 510, is tilted toward the direction of movement of the moving unit 310 from the outside of the third support unit 510 to the inside of the third support unit 510. To explain more specifically referring to FIG. 3 or FIG. 4, the rotation guide 520 may be provided as a plate having a single flat plate. The rotation guide 520 may be provided such that the direction of movement of the driving connection unit 320 and the plane may face with each other in the lower surface of the third support unit 510. As shown in FIG. 4, the rotation guide 520 may be provided to be tilted toward the direction of movement of the moving unit 310 from the outside of the third support unit 510 to the inside of the third support unit 510. The rotation angle of the third support unit 510 varies according to the movement of the moving unit 310 according to the tilt of the rotation guide 520.

The secondary moving unit 530, which, while being provided to move along with the moving unit 310, comes into contact with the rotation guide 520 and pushes while being sled thereby rotating the third support unit 510. To explain more specifically referring to FIG. 3 or FIG. 4, the secondary moving unit 530 may be provided in the driving connection unit 320. The secondary moving unit 530 may be provided so as to slide in contact with the plane of the rotation guide 520. The secondary moving unit may be provided 530 in a curved surface so as to reduce a friction with the plane of the rotation guide 520.

Meanwhile, the secondary moving unit 530 may be provided with a conventional ball caster or roller at an end thereof.

The secondary rehabilitation unit 500 explained in other embodiment, by converting the force generated in one direction totally different from the force generated by a single driving unit 300 through the rotation guide 520 and the secondary moving unit 530, can force an extension exercise in which a thumb of one hand of a rehabilitation patient supported through the first support unit 100 or the second support unit 200 can be extended or clenched. The rotation of the secondary rehabilitation unit 500 may have an internal angle of 45°.

Meanwhile, as in FIG. 5, the secondary rehabilitation unit 500 may further include a secondary return part 540, which, being connected to the third support unit 510 and the first support unit 100, returns the rotated third support unit 510. The secondary return part 540 may be provided with a conventional spring. The secondary return part 540 may be such that one side is connected to a lower surface of the third support unit 510 and the other side is connected to a lower surface of the first support unit 510.

Further, as explained in FIG. 4, the secondary rehabilitation unit 500 explained above may further include another secondary rehabilitation unit 500 on a side opposite to the first support unit 100, in which the secondary rehabilitation unit 500 explained above is provided. A rehabilitation device including two secondary rehabilitation units 500 has the effect of being capable of selectively using either the left hand or right hand.

Meanwhile, the rehabilitation unit 500 explained above may further include a conventional ball caster 600 as illustrated in FIG. 5 or FIG. 6. The ball caster 600 may be provided in a lower surface of the driving unit 300. The ball caster 600 can change the stimulus according to the extension exercise by selectively changing the location of the arm in a state where the arm is rested on the rehabilitation device by allowing the hand of a user to be moved freely at the bottom, and proceed with the extension exercise from fingers to the shoulder.

Additionally, by changing the location of the arm through the ball caster 600, the device has the effect of being capable of performing the extension exercise from fingers to the shoulder.

Further, the rehabilitation device including the ball caster 600 may further include an additional plate body. A ball caster 600 explained above may be provided in the plate body. The plate body may be provided in a lower surface of the driving unit 300. The plate body may be selectively coupled to or separated from the driving unit 300. The driving unit 300 may include a conventional roller that rotates on the upper surface of the plate body. The roller may be controlled through an apparatus such as a conventional motor, etc. In such a rehabilitation device, the driving unit 300 can move forward or backward on the upper surface of the plate body through the roller, and the rehabilitation patient can move the rehabilitation device by moving his/her arm through the ball caster 600. That is, a rehabilitation patient can proceed with an active extension exercise through the plate body in which the ball caster 600 is provided. The rehabilitation patient can perform a passive extension exercise through the roller in which the plate body is separated.

The rehabilitation device with reference to FIG. 5 according to another embodiment may further include a wrist fixing unit 700 and an arm receiving unit 800.

The wrist fixing unit 700 with reference to FIG. 1, FIG. 5, and FIG. 6 is provided in the driving unit 300 thereby fixing the wrist. The wrist fixing unit 700 may be provided with a conventional Velcro band. The wrist fixing unit 700 may be provided on an upper part of the driving unit 300. The wrist fixing unit 700 must be maintained such that the wrist of the rehabilitation patient can be maintained straight.

Meanwhile, the wrist fixing unit 700 may be provided on the surface of the cover covering the rehabilitation device.

The arm receiving unit 800 with reference to FIGS. 1, 5, and 6 is provided in the driving unit 300 to come into contact with a particular part from a wrist to an elbow, and is tilted to the thumb direction (to the left based on FIG. 5) as the arm receiving unit 800 goes upward. To explain more specifically, the arm receiving unit 800 may be provided as a member that can come into contact with at least a part of the lower surface of the arm between the wrist and the elbow. The upper surface of the arm receiving unit 800 in contact with the arm may be provided at a tilted position. As illustrated in FIG. 5, the tilt of the arm receiving unit 800 may be selected from the interior angles between the vertical and the horizontal based on the cut drawings toward the direction of the axis of the first joint unit 410. That is, the arm receiving unit 800 is in a tilted form to the thumb direction (inside) of a rehabilitation patient as the arm receiving unit 800 goes upward. The arm receiving unit 800 does not support the arm of a rehabilitation patient but allows the arm to be supported using the friction coefficient between the arm of the rehabilitation patient and the arm receiving unit 800. The arm receiving unit 800, even when a user selectively shows a little movement in a direction opposite to the thumb, can reduce the friction coefficient thereby allowing the arm to move freely with respect to the wrist. The arm receiving unit 800 allows a rehabilitation patient to move his/her arms freely even with an instant movement. In a case where excessive pain occurs due to the extension exercise caused by the second support unit 200 and the first support unit 100, the rehabilitation patient can easily release the pain by instantly moving the elbows so that the fingers, wrists, and elbows can be straightly aligned.

In the rehabilitation device including the wrist fixing unit 700 and the arm receiving unit 800 explained in another embodiment, if excessive pain occurs when the wrist is tilted due to the extension exercise by the second support unit 200 and the first support unit 100, a rehabilitation patient can straighten the folded wrists by instantly moving the elbows to a lower part of the arm receiving unit 800. Therefore, the rehabilitation device has the effect of easily releasing excessive pain occurred due to extension exercise. Additionally, the rehabilitation patient can resolve the pain problem even with a slight movement and can continue the extension exercise in a state where the pain has not occurred.

From the foregoing, it will be understood that various embodiments of the present disclosure have been described for illustration purposes, and various modifications are possible without departing from the scope and spirit of the present disclosure. In addition, the various embodiments disclosed above are not intended to limit the present disclosure, and the true spirit and scope of the present disclosure will be proposed in the claims below.

In the rehabilitation device disclosed in the present specification, as a primary step, a first-step extension exercise where fingers are flipped to the direction of back of the hands or palms can be performed through the second support unit 200 which rotates by the driving unit 300, and a second-step extension exercise where palms are flipped to the direction of back of the hands or palms in a state where the fingers are flipped through the first support unit 100 which rotates by the movement of the second support unit 200.

EXPLANATION OF REFERENCE NUMERALS

100: first support unit
200: second support unit
300: driving unit
310: moving unit
320: driving connection unit
330: rotation structure
400: joint unit
410: first joint unit
420: second joint unit
430: restriction unit
500: secondary rehabilitation unit
510: third support unit
520: rotation guide
530: secondary moving unit
540: secondary return unit
600: ball caster
700: wrist fixing unit
800: arm resting unit

What is claimed is:

1. A rehabilitation device comprising:
a first support unit adapted to support palms of a rehabilitation patient;
a second support unit which is provided in one side of the first support unit and adapted to support fingers of the rehabilitation patient;
a driving unit which moves the second support unit toward a direction of a back of a hand of the rehabilitation patient; and
a joint unit which allows the first support unit to be tilted as the second support unit moves,
wherein the fingers and palms are allowed to be sequentially bent.

2. The rehabilitation device of claim 1, wherein the joint unit comprises:
a first joint unit which allows the first support unit to rotate freely;
a second joint unit, which, while connecting the first support unit and the second support unit, allows the second support unit to rotate freely; and
a restriction unit, which, while being provided in the first support unit, restricts a rotation of the second support unit thereby rotating the first support unit as the second support unit moves.

3. The rehabilitation device of claim 2, wherein the driving unit comprises:
a moving unit which, while being positioned from the first support unit toward the second support unit, moves forward and backward under the first support unit or the second support unit;
a driving connection unit which connects the moving unit and the second support unit; and
a rotation structure which allows the driving connection unit to rotate freely by a forward movement of the moving unit thereby moving the second support unit upward.

4. The rehabilitation device of claim 3, further comprising a secondary rehabilitation unit, which, being provided in the first support unit, allows a thumb of the fingers of the rehabilitation patient to be folded and then extended, wherein the secondary rehabilitation unit comprising:
a third support unit, which, being provided in the first support unit, is provided in one side of the second support unit, thus being able to rotate toward a direction of a side of the second support unit;
a rotation guide, which, while being protruded in a lower part of the third support unit, is tilted toward a direction of movement of the moving unit from an outside of the third support unit to an inside of the third support unit; and
a secondary moving unit, which, while being provided to move along with the moving unit, comes into contact with the rotation guide and pushes the rotation guide while being sled thereby rotating the third support unit.

5. The rehabilitation device of claim 4, wherein the secondary rehabilitation unit is provided on each side of both sides of the second support unit.

6. The rehabilitation device according to claim 4, wherein the secondary rehabilitation unit further comprises a secondary return unit which, while being connected to the third support unit and the first support unit, returns the rotated third support unit.

7. The rehabilitation device of claim 6, further comprising a ball caster, which, being provided in a lower part of the driving unit, allows rehabilitation device to move freely by an external force.

8. The rehabilitation device of claim 1, further comprising:
a wrist fixing unit being provided in the driving unit and adapted to fix a wrist of the rehabilitation patient; and
an arm resting unit being provided in the driving unit and adapted to contact with a particular part from the wrist to an elbow of the rehabilitation patient, wherein the arm resting unit is tilted toward a thumb direction as the arm resting unit faces upward.

9. The rehabilitation device according to claim 5, wherein the secondary rehabilitation unit further comprises a secondary return unit which, while being connected to the third support unit and the first support unit, returns the rotated third support unit.

10. The rehabilitation device of claim 9, further comprising a ball caster, which, being provided in a lower part of the driving unit, allows the rehabilitation device to move freely by an external force.

* * * * *